US009799264B2

(12) United States Patent
Eom et al.

(10) Patent No.: US 9,799,264 B2
(45) Date of Patent: Oct. 24, 2017

(54) METHOD AND APPARATUS FOR REDUCING IMAGE STICKING EVENT ON GRAPHICAL USER INTERFACE

(75) Inventors: Sang Yong Eom, Suwon-si (KR); Dong Sub Kim, Suwon-si (KR); Joon Gyu Lee, Ansan-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 183 days.

(21) Appl. No.: 13/410,889

(22) Filed: Mar. 2, 2012

(65) Prior Publication Data

US 2012/0236040 A1 Sep. 20, 2012

(30) Foreign Application Priority Data

Mar. 18, 2011 (KR) ..... 10-2011-0024480

(51) Int. Cl.
*G09G 3/32* (2016.01)
*G09G 3/3225* (2016.01)
*G09G 3/00* (2006.01)

(52) U.S. Cl.
CPC ..... *G09G 3/3225* (2013.01); *G09G 3/007* (2013.01); *G09G 2320/046* (2013.01)

(58) Field of Classification Search
USPC ..... 345/672
See application file for complete search history.

(56) References Cited

U.S. PATENT DOCUMENTS

| | | | | |
|---|---|---|---|---|
| 2004/0239663 | A1 | 12/2004 | Seki et al. | |
| 2006/0132437 | A1 | 6/2006 | Kim | |
| 2006/0187158 | A1 | 8/2006 | Wakabayashi et al. | |
| 2009/0213130 | A1 | 8/2009 | Onodera et al. | |
| 2010/0053408 | A1 | 3/2010 | Ozawa et al. | |
| 2010/0162160 | A1* | 6/2010 | Stallings et al. | 715/784 |
| 2010/0245339 | A1 | 9/2010 | Lin | |
| 2011/0014730 | A1* | 1/2011 | Yamazaki et al. | 438/23 |
| 2012/0188262 | A1* | 7/2012 | Rabii | 345/534 |

FOREIGN PATENT DOCUMENTS

| | | | |
|---|---|---|---|
| CN | 1825416 | A | 8/2006 |
| CN | 101515108 | A | 8/2009 |
| CN | 101777315 | A | 7/2010 |
| JP | 2000-227775 | A | 8/2000 |
| JP | 2003-150140 | A | 5/2003 |
| JP | 2004-354685 | A | 12/2004 |
| JP | 2005-037843 | A | 2/2005 |
| JP | 2009-230079 | A | 10/2009 |
| KR | 10-2005-0048300 | A | 5/2005 |
| KR | 10-2010-0050823 | A | 5/2010 |
| RU | 2009 132 437 | A | 3/2011 |

* cited by examiner

*Primary Examiner* — Vu Nguyen
(74) *Attorney, Agent, or Firm* — Jefferson IP Law, LLP

(57) ABSTRACT

A method and an apparatus for providing a Graphical User Interface (GUI) on an Active Matrix Organic Light-Emitting Diode (AMOLED) display of a device for reducing an image sticking effect are provided. The method includes displaying at least one item at an initial position on a screen of the display device, turning off the screen according to a predefined condition, receiving a display-on input command, and shifting the at least one item as much as a predefined distance from the initial position on the screen.

20 Claims, 11 Drawing Sheets

METHOD AND APPARATUS FOR REDUCING IMAGE STICKING EVENT ON GRAPHICAL USER INTERFACE

PRIORITY

This application claims the benefit under 35 U.S.C. §119 (a) of a Korean patent application filed on Mar. 18, 2011 in the Korean Intellectual Property Office and assigned Serial No. 10-2011-0024480, the entire disclosure of which is hereby incorporated by reference.

BACKGROUND OF THE INVENTION

1. Field of the Invention

The present invention relates to a Graphical User Interface (GUI) of a display device. More particularly, the present invention relates to a method and an apparatus for providing a GUI on an Active Matrix Organic Light-Emitting Diode (AMOLED) display of a device for reducing an image sticking effect.

2. Description of the Related Art

When a static image is displayed on a Liquid Crystal Display (LCD) for an undesirably extended period of time, the so called image sticking effect can occur. In a case of a Thin Film Transistor-LCD (TFT-LCD), the sticking of the liquid crystal to a static image causes a temporary ghost image, while it is caused, in Active Matrix Organic Light-Emitting Diode (AMOLED), by the reduction of the emitting efficiency of the pixels emitting lights for presenting a specific image as time progresses.

More specifically, AMOLED is a self light emitting device including red, green, and blue pixels, and their brightness decreases as the accumulated display time is prolonged.

FIG. 1A is a graph illustrating decreases in brightness of red, green, and blue pixels as accumulated display time is prolonged according to the related art.

Referring to FIG. 1A, the brightness of all of the red, green, and blue pixels decreases as time progresses, and the brightness of the blue pixel decreases relatively fast as compared to the red and green pixels.

More particularly, in a case of a high-gray image, all of the red, green, and blue pixels are emitting light and, as the light emission time is prolonged, the brightness of all of the red, green, and blue pixels decreases such that, when the image is changed, the image sticking effect occurs.

FIG. 1B illustrates an example of an image sticking effect according to the related art.

Referring to part [a] of FIG. 1B, in a state where a high-gray image is displayed in a first region 11 while a relatively low-gray image is displayed in a second region 12, if the gray image identical with that in the first region 11 is displayed in the second region 12, a temporary ghost image appears in the first region 11, as shown in part [b] of FIG. 1B. This is because the brightness decreases faster in the first region 11 than in the second region 12.

The stuck image inconveniences a user even when a certain application is executed.

Therefore, a need exists for a method and a display device that is capable of reducing the image sticking effect caused by displaying a static image for an undesirably extended period of time.

SUMMARY OF THE INVENTION

Aspects of the present invention are to address at least the above-mentioned problems and/or disadvantages and to provide at least the advantages described below. Accordingly, an aspect of the present invention is to provide a method and a display device that is capable of reducing an image sticking effect caused by displaying a static image for an undesirably extended period of time.

In accordance with an aspect of the present invention, a method for providing a Graphical User Interface (GUI) for reducing an image sticking effect in a display device is provided. The method includes displaying at least one item at an initial position on a screen of the display device, turning off the screen according to a predefined condition, receiving a display-on input command, and shifting the at least one item as much as a predefined distance from the initial position on the screen.

In accordance with another aspect of the present invention, a display device is provided. The device includes a display unit for displaying at least one item at an initial position, a display on/off control unit for controlling on/off a screen of the display device according to a predefined condition, an input unit for receiving a display-on input command, and an item shift unit for controlling, when the display-on command is input through the input unit in an off-state of the screen, the display unit to display the at least one item at a position as distant as a predefined distance from the initial position.

In accordance with another aspect of the present invention, an electronic apparatus is provided. The apparatus includes a display unit having a plurality of self light emitting pixel elements and a predefined status display area to display a status item, and a control unit for changing a position of the status item displayed on the status display area by shifting the position of the status item by one or two pixels such that partially different sets of the self light emitting pixel elements are energized to display the status item.

In accordance with another aspect of the present invention, an electronic apparatus is provided. The apparatus includes a display unit having a plurality of self light emitting pixel elements, and a control unit for displaying a status item at an initial location within a subregion of the display unit and for changing a position of the status item to a different location within the subregion such that the status item, in its entirety, continuously remains within a boundary of the subregion having a width that is less than twice a width of the status item and such that partially different sets of the self light emitting pixel elements are energized to display the status item.

Other aspects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other aspects, features, and advantages of the present invention will be more apparent from the following description taken in conjunction with the accompanying drawings, in which.

Throughout the drawings, it should be noted that like reference numbers are used to depict the same or similar elements, features, and structures.

DETAILED DESCRIPTION OF EXEMPLARY EMBODIMENTS

Figure 1A:
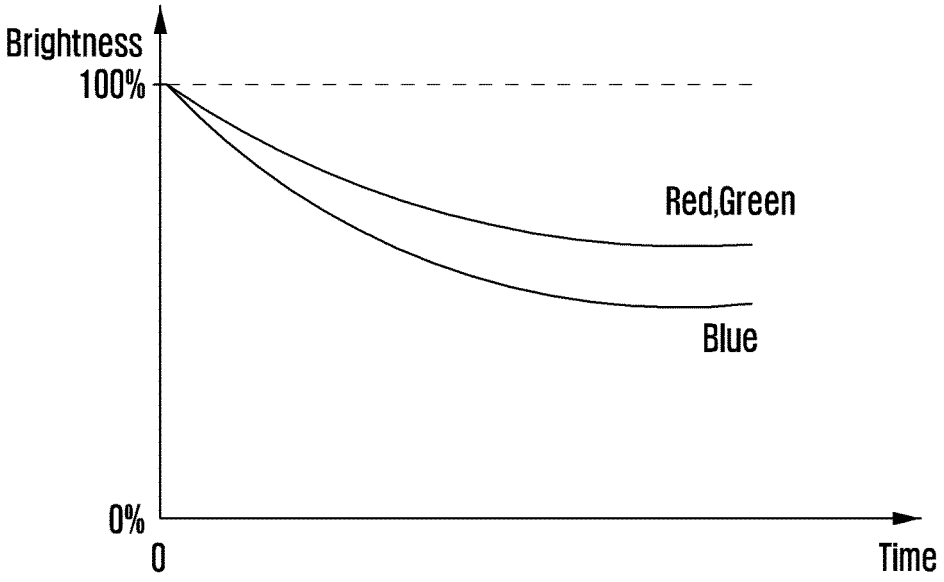
FIG. 1A (RELATED ART)
FIG. 1A is a graph illustrating decreases in brightness of red, green, and blue pixels as accumulated display time is prolonged according to the related art.
Figure 1B:
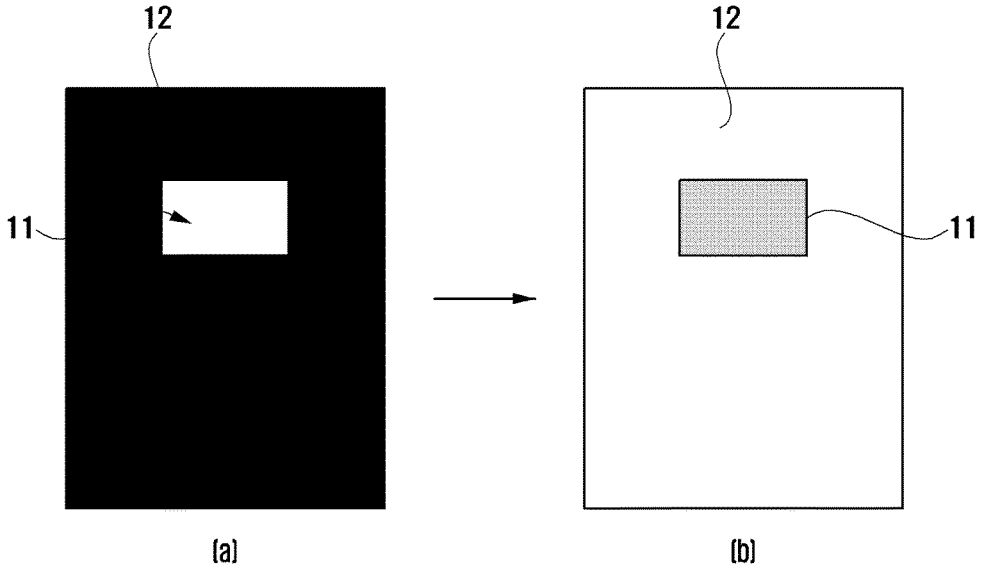
FIG. 1B (RELATED ART)
FIG. 1B illustrates an example of an image sticking effect according to the related art.

The following description with reference to the accompanying drawings is provided to assist in a comprehensive understanding of exemplary embodiments of the invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. In addition, descriptions of well-known functions and constructions may be omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to skill in the art, may occur in amounts that do not preclude the effect the characteristic was intended to provide.

In exemplary embodiments of the present invention, the term 'item' denotes an image object providing information on the current status of a display device and can be an application execution icon or status item. The display device is implemented in a mobile terminal, and the image object providing the current status information of the display device indicates a cellular radio reception strength, a Wireless-Fidelity (Wi-Fi) radio reception strength, a current time, a battery status, an alarm setting, a Bluetooth radio on/off status, and a Global Positioning System (GPS) on/off status.

The display device, according to an exemplary embodiment of the present invention, may be a mobile terminal or a non-portable display device, such as a TV or a monitor. The mobile terminal can be any information communication device or multimedia device, such as a Portable Multimedia Player (PMP), a Personal Digital Assistant (PDA), a Smartphone, a (Motion Pictures Expert Group (MPEG)-1 or MPEG-2 layer-3 (MP3) player, and the like. In the following, the description is directed to the mobile terminal as a display device.

In exemplary embodiments of the present invention, the display unit of the mobile terminal is implemented with an Active Matrix Organic Light-Emitting Diode (AMOLED).

FIGS. 2 through 10, discussed below, and the various exemplary embodiments used to describe the principles of the present disclosure in this patent document are by way of illustration only and should not be construed in any way that would limit the scope of the disclosure. Those skilled in the art will understand that the principles of the present disclosure may be implemented in any suitably arranged communications system. The terms used to describe various embodiments are exemplary. It should be understood that these are provided to merely aid the understanding of the description, and that their use and definitions in no way limit the scope of the invention. Terms first, second, and the like are used to differentiate between objects having the same terminology and are in no way intended to represent a chronological order, unless where explicitly state otherwise. A set is defined as a non-empty set including at least one element.

Figure 2:
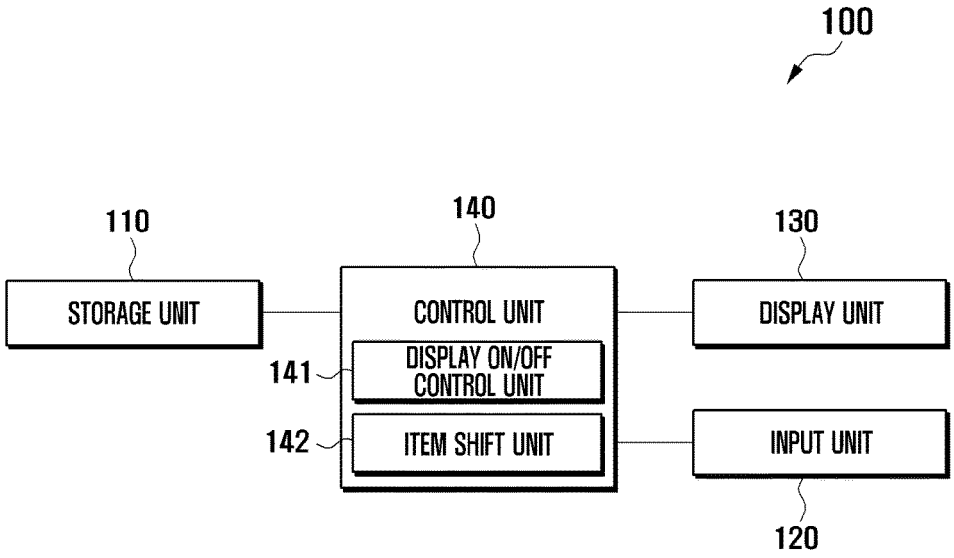
FIG. 2 is a block diagram illustrating a configuration of a display device according to an exemplary embodiment of the present invention.

FIG. 2 is a block diagram illustrating a configuration of a display device according to an exemplary embodiment of the present invention.

Referring to FIG. 2, a display device 100 includes a storage unit 110, an input unit 120, a display unit 130, and a control unit 140.

The storage unit 110 is a component for storing programs and data necessary for the operations of the display device 100 and can store the Operating System (OS) for booting up the display device 100 and applications and data, such as an image, an audio, a video, and the like. The storage unit 110 stores an algorithm for moving items on the screen.

The input unit 120 receives a key manipulation signal, input by the user, for controlling the display device and delivers the signal to the control unit 140. The input unit 120 can be implemented with a keypad having buttons, such as 3×4 keypad, a QWERTY keypad, and a touch panel. The input unit 120 can include a predefined number of button keys, a jog key, a wheel key, and the like. The input unit generates a signal for executing an application stored in the storage unit 110 to the control unit 140 according to a user input. The input unit 120 can generate a signal for turning off or on the display unit 130 to the control unit 140.

The display unit 130 can be implemented with Organic Light Emitting Diodes (OLED), and preferably with Active Matrix Organic Light Emitting Diodes (AMOLED). The display unit 130 outputs a booting progress screen, a standby screen, a menu screen, and an application execution screen. The display unit 130 is turned on/off under the control of an on/off control unit 141 and shifts an item under the control of an item shift unit 142.

The control unit 140 is a component for controlling overall operations of the display device 100 and includes the display on/off control unit 141 and the item shift unit 142.

The display on/off control unit 141 is responsible for controlling on/off of the display unit 130. The display on/off control unit 141 controls to turn off or on the display unit 130 in response to the display off or on signal input through the input unit 120. The display on/off control unit 141 initiates a timer upon the turn-on of the display unit 130 to count the elapsed time and turns off the display unit 130 when the elapsed time reaches a predefined value.

The item shift unit 142 is responsible for controlling the change of an item in position on the display unit 130.

According to an exemplary embodiment of the present invention, the item can be an image object providing current status information of the display device 100 and can be an application execution icon. In a case where the display device 100 is a mobile communication terminal, the image object providing the current status information of the display device 100 can be an indicator of cellular radio reception strength, a Wi-Fi radio reception strength, a current time, battery information, an alarm setting, a Bluetooth on/off status, or a GPS on/off status. According to an exemplary embodiment of the present invention, a plurality of image objects providing the current status information of the display device 100 can be arranged in a row at a specific region of the display unit 130. For example, the image objects can be arranged in a horizontal direction at the top region of the display unit 130.

The item shift unit 142 may control the display unit 130 to display the items at positions at a predefined distance from their previous positions in response to a display-on input command in the off-state of the display unit 130.

The item shift unit 142 may also determine whether a timer initiated when the items are arranged at their positions reaches a predefined period T, determines, if so, whether the display unit is in an on-state and, if so, controls the display unit 130 to shift the items to positions at a predefined distance from their previous position. If it is determined that the display unit 130 is in the off-state when the counter reaches the period T, the item shift unit 142 determines whether a display-on command is input by means of the input unit 120 and, if so, controls the display unit 130 to display the items at the positions at a predefined distance from their previous positions.

If a display-on command is input in the off-state of the display unit, the item shift unit 142 may control the display of some of the items at positions at a predefined interval from their previous positions on the display unit 130. The item shift unit 142 may also control the display unit 130 such that the items are shifted one by one or group by group, each including two items, in a predefined order.

The items are categorized into the first and second regions, and if a display-on command is input in the off-state of the display unit 130, the item shift unit 142 controls the display of the items of the first region at positions at a predefined interval from their previous positions and determines a number of accumulated on/off operations of the display unit 130. If it is determined that the number of the accumulated on/off operations reaches a predefined value K, the item shift unit 142 controls the display unit 130 such that the items of the second region are displayed at positions at a predefined interval from their previous positions right before the off-state of the display unit 130 and initializes the on/off operation counter to 0.

With the background knowledge on the configuration of the display device described above, a description is made of a method for providing a Graphical User Interface (GUI) for reducing the image sticking effect in the display device hereinafter.

Figure 3:
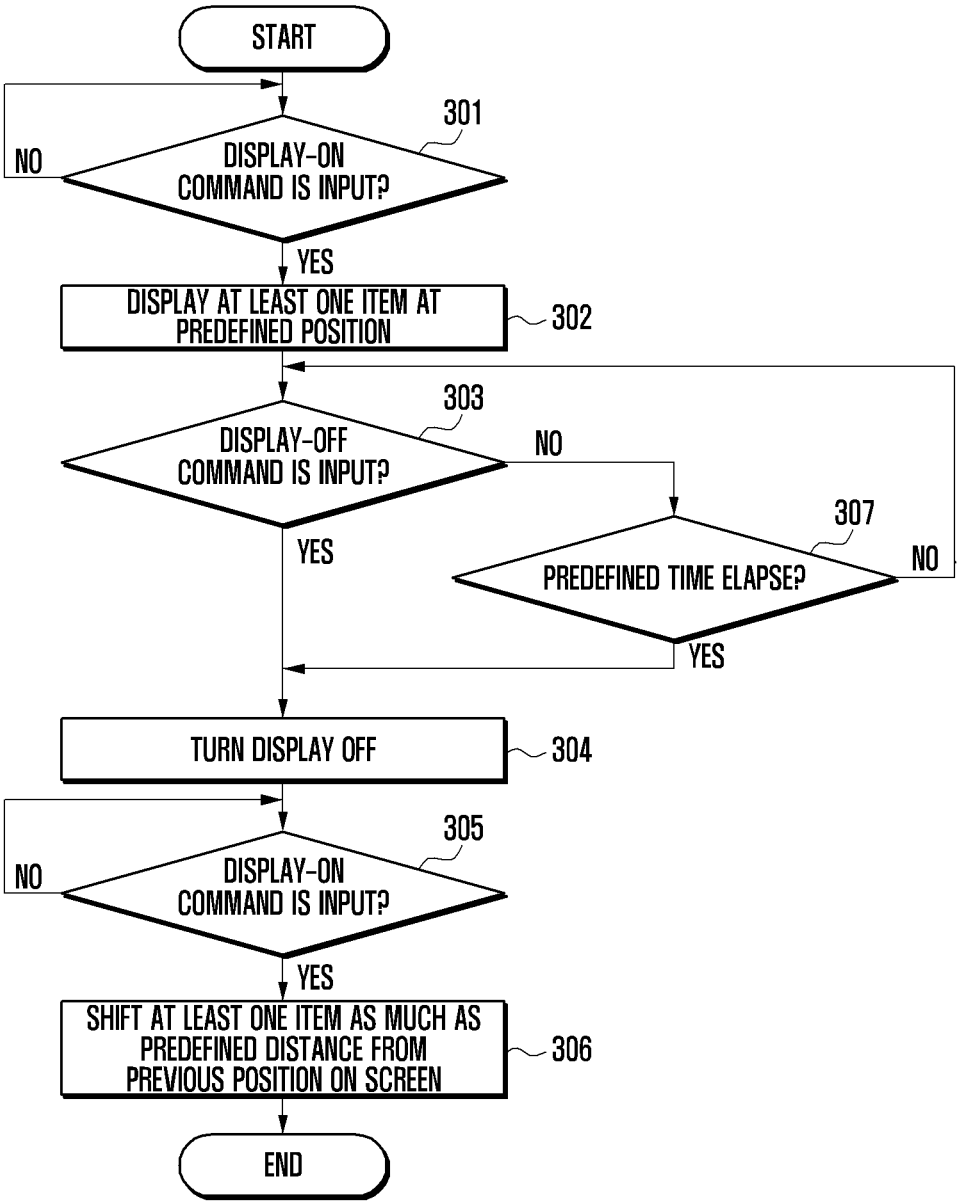
FIG. 3 is a flowchart illustrating a method for providing a Graphical User Interface (GUI) for reducing an image sticking effect in a display device according to an exemplary embodiment of the present invention.

FIG. 3 is a flowchart illustrating a method for providing a GUI for reducing an image sticking effect in a display device according to an exemplary embodiment of the present invention.

Referring to FIG. 3, a control unit 140 monitors to detect a display-on command input by the input unit 120 at step 301. The user can input the display-on command by selecting an on/off key of the display device 100 or, in a case of using a touchscreen, by touching an on/off key displayed on the touchscreen.

If it is determined at step 301 that the display-on command is input through the input unit 120, the control unit 140 controls the display unit 130 to display at least one item at a predefined position at step 302. The item is an image object which is changed in a relatively low frequency and can be the image object indicating current status information of the display device 100. The current status information of the display device 100 can be any one of the cellular radio reception strength, the Wi-Fi radio reception strength, the current time, the battery status, the alarm setting, the Bluetooth radio on/off status, and the GPS on/off status.

When the display unit 130 displays at least one item, the control unit controls the display unit 130 such that the at least one item is arranged in a row at a predefined region of the screen. For example, the control unit 140 can control the display unit 130 to display the items in a row horizontally in a region having a predefined width.

The display device 100 is configured with the information on the positions of the items when the items are displayed initially, and the control unit 140 controls the display unit 130 to display the items according to the information on the positions of the items at step 302.

At step 303, the display on/off control unit 141 determines whether a display-off command is input through the input unit 120. The user can input the display off command by selecting the display on/off key provided on the display device 100.

If it is determined at step 303 that the display-off command is input through the input unit 120, the display on/off control unit 141 turns off the display unit 130 at step 304.

Thereafter, the display on/off control unit 141 monitors the input of the display-on command at step 305, and if the display-on command is input, turns on the display unit 130 and sends the item shift unit 142 a signal notifying of the turn-on of the display unit 130. If the turn-on notification signal is received from the display on/off control unit 141, the item shift unit 142 controls the display unit 130 to display the at least one item at positions at a predefined distance from the previous positions before the turn-off of the display unit 130 at step 306.

The item shift unit 142 shifts all the items as arranged. For example, when a plurality of items are arranged in a row horizontally, the item shift unit 142 can shift the items, as arranged, in a left or a right direction by as much as a predefined distance. In addition, when a plurality of items are arranged in a row vertically, the item shift unit 142 can shift the items as arranged in an upward or a downward direction by as much as a predefined distance.

The predefined distance can be one or two pixels. The item shift unit 142 shifts the items as much as one or two pixels and thus, it is difficult for the user to perceive the shift of the items.

The item shift unit 142 shifts the items along a predefined path. In an exemplary implementation where the items are arranged in horizontal direction, the item shift unit 142 can shift the items by 1 pixel in the range of two pixels to the left and right directions whenever the display unit 130 transitions from the off-state to the on-state. Assuming that the reference point is (0, 0) at the initial presentation of the items, the item shift unit 142 can shift the item to the positions (−1, 0), (−2, 0), (0, 0), (+1, 0), (+2, 0), (+1, 0), and (0, 0) in sequence.

Whenever the display unit 130 transitions from the off-state to the on-state, the item shift unit 142 can shift the items by pixel to the left, right, upward, and downward directions in the range of 1 pixel. That is, assuming that the reference point is (0, 0) at the initial presentation of the items, the item shift unit 142 can shift the items to the positions (−1, 0), (−1, −1), (0, −1), and (0, 0) in sequence.

If the display-off command is not detected at step 303, the display on/off control unit 141 determines whether a predefined time has elapsed after the presentation of the items at step 307. If it is determined that the predefined time has elapsed at step 307, the display on/off control unit 141 turns off the display unit 130 at step 304, and the display on/off control unit 131 and item shift unit 142 execute steps 305 and 306.

Figure 4:
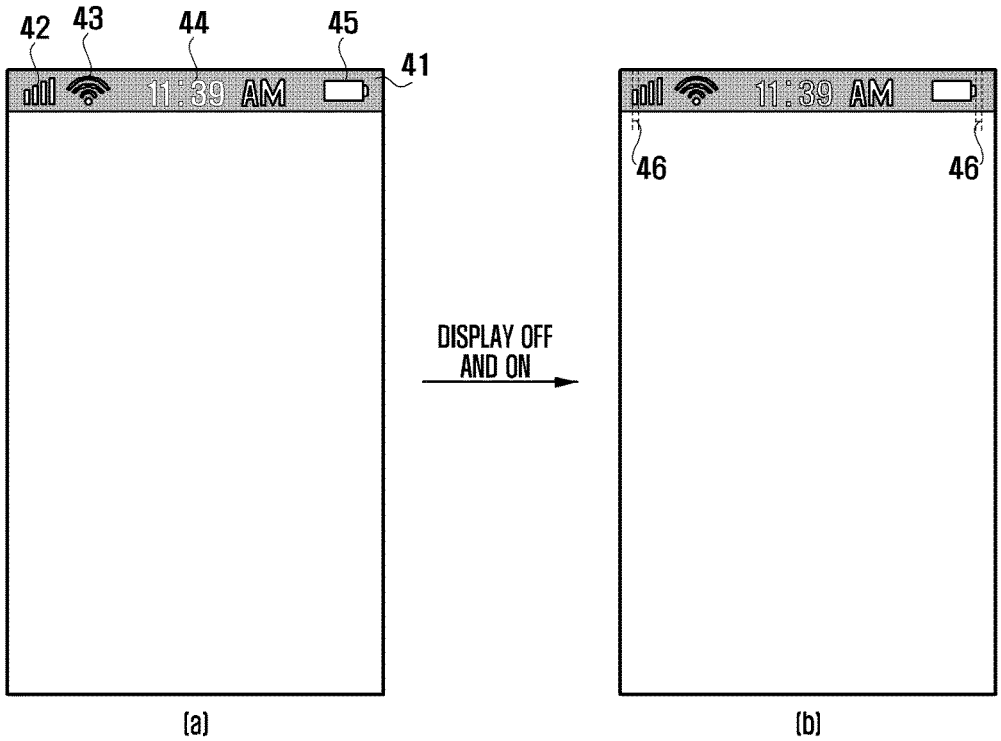
FIG. 4 illustrates screen images for explaining how to shift items on a screen of a display device according to an exemplary embodiment of the present invention.

FIG. 4 illustrates screen images for explaining how to shift items on a screen of a display device according to an exemplary embodiment of the present invention.

Referring to part [a] of FIG. 4, it shows the screen having an indicator region 41 arranged at the top and presenting a plurality of items 42, 43, 44, and 45 indicating current status information of the display device 100. The indicator region 41 includes the cellular radio reception strength indicator item 42, the Wi-Fi radio reception strength indicator item 43, the current time indicator item 44, and a battery indicator item 45.

Referring to part [b] of FIG. 4, it shows the screen presented when the display unit 130 transitions from the off-state, as shown in the screen of part [a] of FIG. 4, to the on-state. As shown in part [b] of FIG. 4, the items 42, 43, 44, and 45 are shifted to the left by as much as a predefined distance 46 as compared to the screen of part [a] of FIG. 4. In part [b] of FIG. 4, the predefined distance can be one or two pixels.

Figure 5:
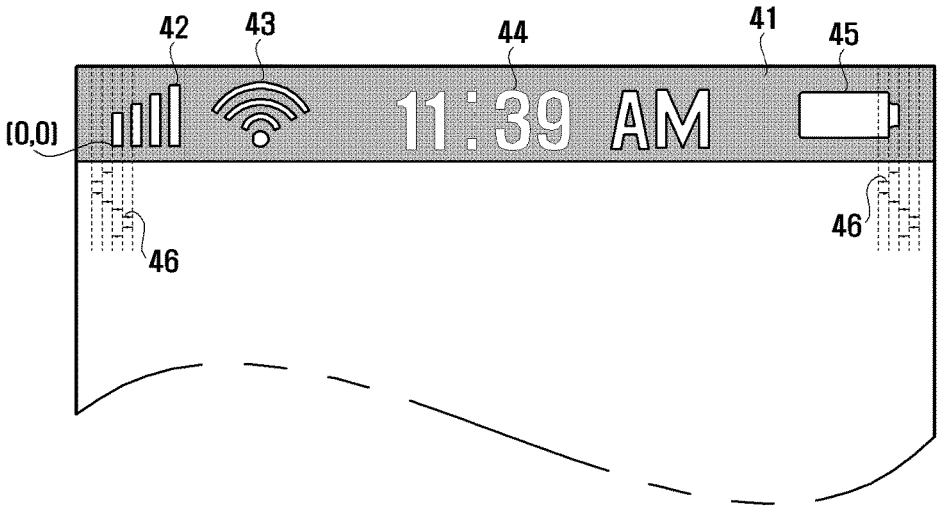
FIG. 5 illustrates a shift pattern of items in an indicator region of a screen of a display device according to an exemplary embodiment of the present invention.

FIG. 5 illustrates a shift pattern of items in an indicator region of a screen of a display device according to an exemplary embodiment of the present invention.

Referring to FIG. 5, items 42, 43, 44, and 45 are shifted as much as a predefined distance whenever the display unit 130 transitions from the off-state to the on-state, e.g., shifted twice to the left, four times to the right, and twice to the left. Assuming that the predefined distance 46 is one pixel, the items 42, 43, 44, and 45 are shifted 2 pixels to the left, 4 pixels to the right, and 2 pixels to the left in unit of 1 pixel. That is, assuming that the left bottom point of the cellular radio reception strength indicator item 42 is (0, 0), this point shifts to the points (−1, 0), (−2, 0), (0, 0), (+1, 0), (+2, 0), (+1, 0), and (0, 0) in sequence whenever the display unit 130 transitions from the off-state to the on-state.

According to the exemplary embodiments depicted in FIGS. 3 through 5, when the display unit 130 transitions from the off-state to the on-state, the display device 100 shifts the items changed in relatively low frequency as much as a predefined distance so as to prevent these items from being displayed at the same positions for an undesirably extended period of time, thereby reducing the created image sticking effect. More particularly, the display device 100 shifts the items in unit of minimum distance, i.e., one pixel, it is possible to maximize the image sticking effect reduction efficiency without user's awareness of the shifts of the items.

Figure 6:
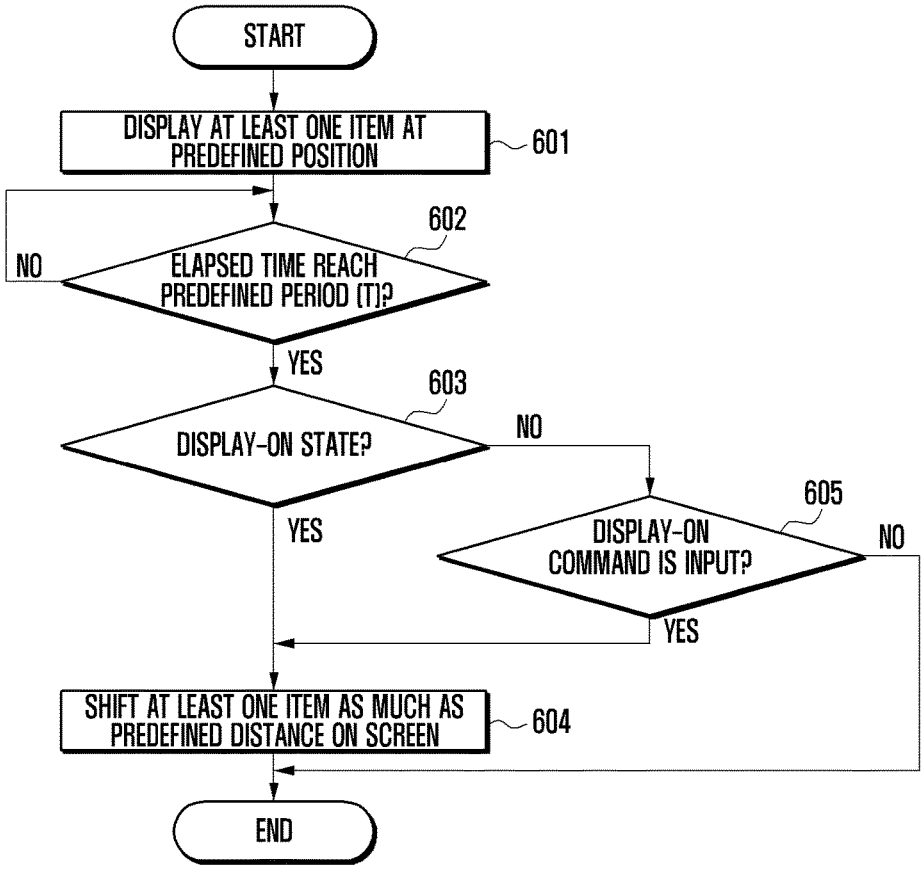
FIG. 6 is a flowchart illustrating a method for providing a GUI for reducing an image sticking effect in a display device according to an exemplary embodiment of the present invention.

FIG. 6 is a flowchart illustrating a method for providing a GUI for reducing an image sticking effect in a display device according to an exemplary embodiment of the present invention.

Referring to FIG. 6, a display device 100 shifts the positions of at least one item periodically. A control unit 140 controls the display unit 130 to display at least one item at a predefined position on the screen at step 601. The display device 100 has the information on the initial positions of the items, and the control unit 140 controls the display unit 130 to display the items at the initial positions at step 601. After displaying the items, the item shift unit 142 starts a timer to count the time elapsed.

The item shift unit 142 determines whether the count reaches the preset period T at step 602. If the count reaches the present period T, the item shift unit 142 determines whether the display unit 130 is in the on-state at step 603 and, if so, controls the display unit 130 to shift the at least one item on the screen as much as a predefined distance at step 604.

If it is determined that the display unit 130 is in the off-state at step 603, the item shift unit 142 determines whether a display-on command is input at step 605. If the user inputs the display-on command by means of the input unit 120, the display on/off control unit 141 notifies the item shift unit 142 of the input of the display-on command. Thereafter, the item shift unit 142 controls the display unit 130 to shift the at least one item as much as the predefined distance at step 604. At this time, the item shift unit 142 controls the display unit 130 to display the items at the position distant from the previous position right before the off-state as much as the predefined distance. The item shift operations described with reference to FIGS. 4 and 5 can be applied to the exemplary embodiment of FIG. 6 in the same manner.

Figure 7:
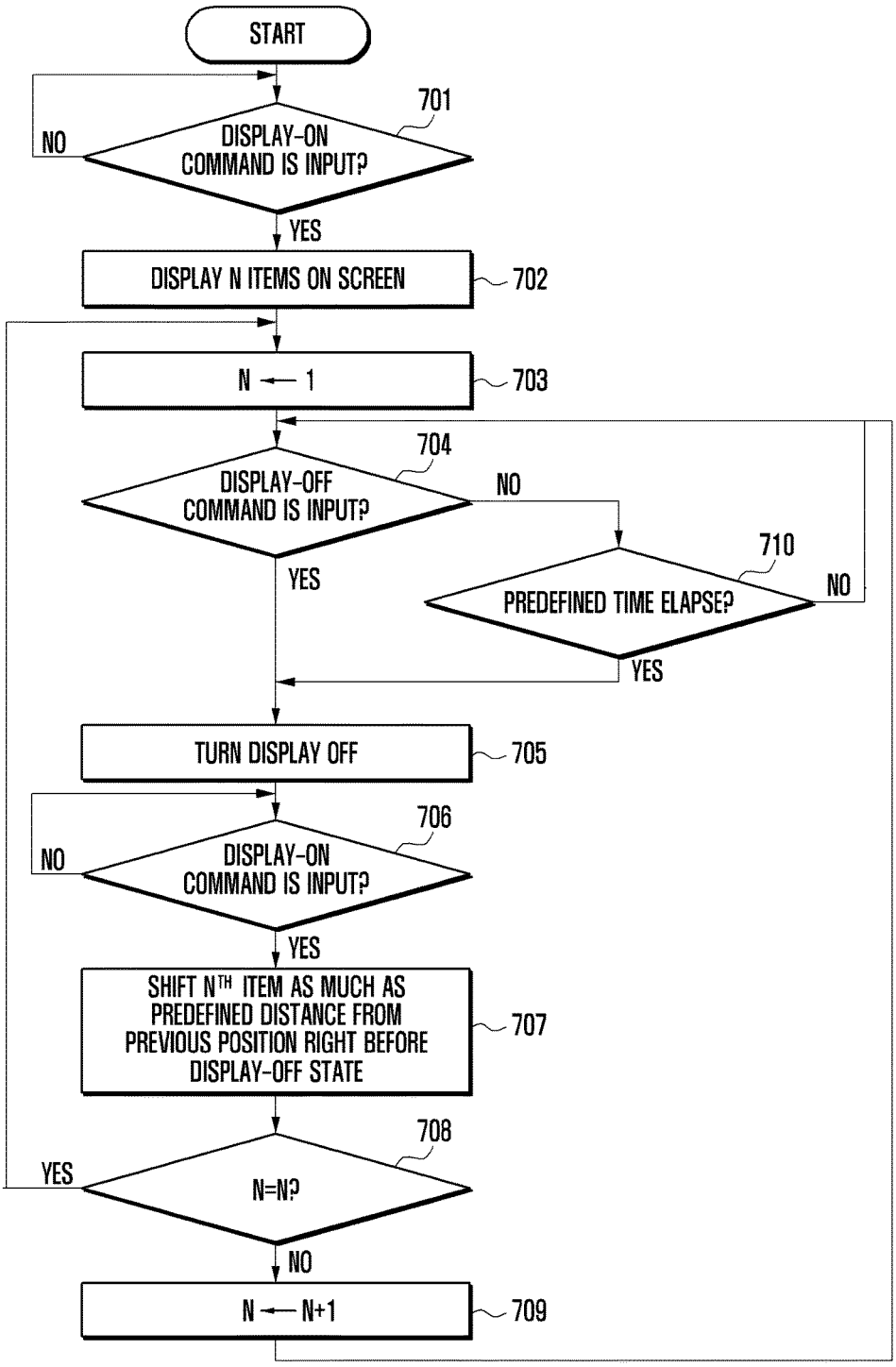
FIG. 7 is a flowchart illustrating a method for providing a GUI for reducing an image sticking effect in a display device according to an exemplary embodiment of the present invention.

FIG. 7 is a flowchart illustrating a method for providing a GUI for reducing an image sticking effect in a display device according to an exemplary embodiment of the present invention.

Referring to FIG. 7, the control unit 140 determines whether a display-on command is input through the input unit 120 at step 701 and, if the display-on command is input, controls the display unit 130 to display N items on the screen at step 702. The N items are assigned sequence numbers from 1 to N.

The item shift unit 142 sets the variable n to 1 at step 703. Here, n denotes the sequence number of the item to be shifted, and the item shift unit 142 selects the first item among the first to Nth items at step 703.

The display on/off control unit 141 determines whether a display-off command is input through the input unit 120 at step 704. If it is determined that the display-off command is input at step 704, the display on/off control unit 141 turns off the display unit 130 at step 705.

The display on/off control unit 141 then determines whether a display-on command is input through the input unit 120 at step 706. If it is determined that the display-on command is input at step 706, the display on/off control unit 141 turns on the display unit 130 and sends the item shift unit 142 a signal notifying of the input of display-on command. Thereafter, if the signal is received from the display on/off control unit 141, the item shift unit 142 controls the display unit 130 to shift the nth item to a position distant from the previous position right before the off-state of the display unit 130 as much as the predefined distance at step 707. In a case that n is set to 1, the item shift unit 142 controls the display unit 130 to shift the first item on the screen.

The item shift unit 142 shifts the items one by one. In an exemplary implementation where the items are arranged in a row horizontally, the item shift unit 142 shifts the items in sequence from the most left one, to the left.

The item shift unit 142 can shift the items according to a predefined path. In an exemplary implementation where the items are arranged in horizontal direction, the item shift unit 142 shifts the items in sequence from the most left one to the most right one in a leftward direction and from the most right one to the most left one in a rightward direction, whenever the display unit 130 transitions from the off-state to the on-state. At this time, the distance between two items is maintained without overlapping with each other after the items are shifted.

Thereafter, the item shift unit 142 determines whether n is equal to N at step 708. If n is equal to N, the item shift unit 142 initializes n to 1 at step 703 such that the display on/off control unit 141 and the item shift unit 142 perform steps 704 to 707.

If n is not equal to N at step 708, the item shift unit 142 sets n to n+1 at step 709 such that the display on/off control unit 141 and the item shift unit 142 perform steps 704 to 707.

If it is determined that the display-off command is not input at step 704, the display on/off control unit 141 determines whether a predefined time has been elapsed after the items has been displayed at step 710. If the predefined time has been elapsed, the display on/off control unit 141 turns off the display unit 130 at step 705 such that the display on/off control unit 141 and the item shift unit 142 perform steps 706 and 707.

Although the display device 100 shifts the items in order from the first item to Nth item in sequence for the first shift round and shifts the items in the same order for the next shift round in the embodiment of FIG. 7, the present invention is not limited thereto, but the items can be shifted in order of the first to Nth items for the first shift round and in reverse order for the next shift round.

Although the display device 100 shifts the items one by one in the exemplary embodiment of FIG. 7, the present invention is not limited thereto, the display device 100 can be configured for shifting the items in unit of a group including two or more items.

Figure 8:
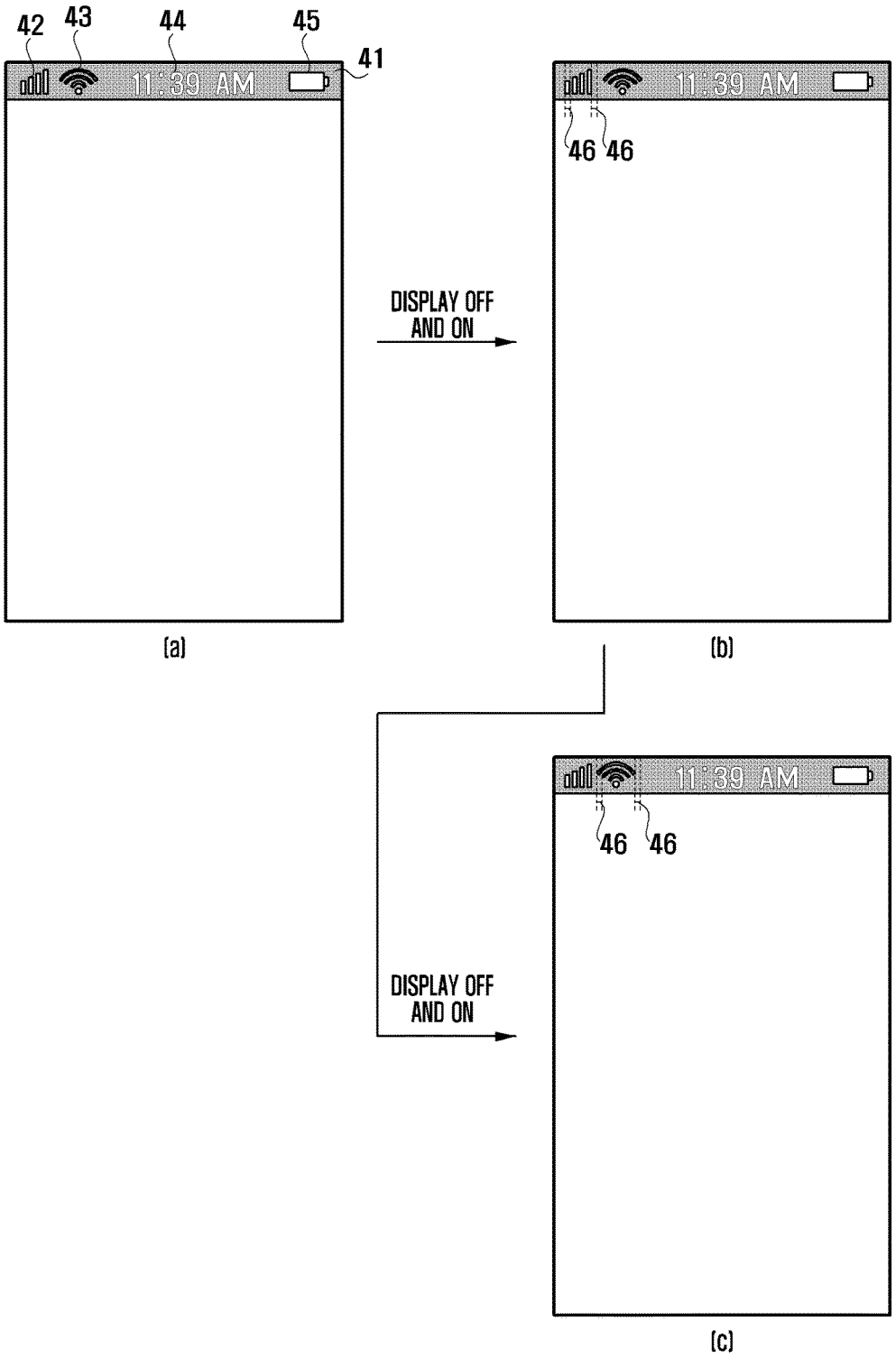
FIG. 8 illustrates screen images for explaining how to shift items on a screen of a display device according to an exemplary embodiment of the present invention.

FIG. 8 illustrates screen images for explaining how to shift items on a screen of a display device according to an exemplary embodiment of the present invention.

Referring to FIG. 8, like part [a] of FIG. 4, part [a] of FIG. 8 shows a screen having an indicator region 41 arranged at the top and presenting a plurality of items 42, 43, 44, and 45 indicating current status information of the display device 100. The indicator region 41 includes the cellular radio reception strength indicator item 42, the Wi-Fi radio reception strength indicator item 43, the current time indicator item 44, and a battery indicator item 45.

Part [b] of FIG. 8 shows the screen presented when the display unit 130 transitions from the off-state, as shown in the screen of part [a] of FIG. 8, to the on-state. In part [b] of FIG. 8, the cellular radio reception strength indicator item 42 is shifted to the left as much as a predefined distance 46 in the indicator region 41 as compared to the screen of part [a] of FIG. 8 while other items 43, 44, and 45 maintain their positions as in part [a] of FIG. 8.

Part [c] of FIG. 8 shows the screen presented when the display unit 130 transitions from the on-state, as shown in the screen of part [b] of FIG. 8, to the off-state. In part [c] of FIG. 8, the Wi-Fi radio strength indicator item 43 is shifted to the left as much as the predefined distance 46 as compared to the screen of part [b] of FIG. 8 while other items 42, 44, and 45 maintain their positions as in part [b] of FIG. 8.

In the exemplary embodiments of FIGS. 7 and 8, since one or a few of the items, rather than all, are shifted, it is possible to reduce the image sticking effect efficiently while minimizing the change of the presentation on the screen.

Figure 9:
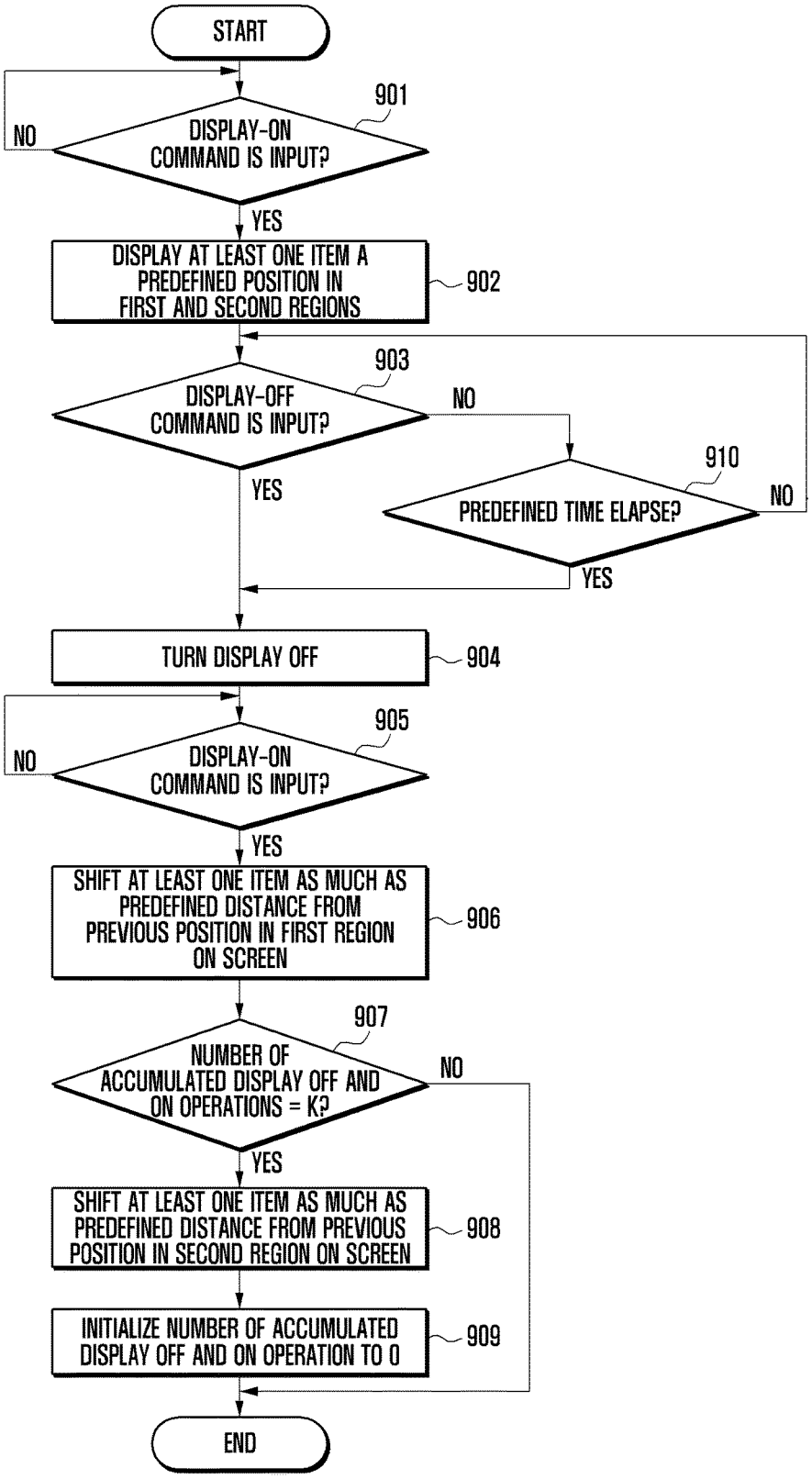
FIG. 9 is a flowchart illustrating a method for providing a GUI for reducing an image sticking effect in a display device according to an exemplary embodiment of the present invention.

FIG. 9 is a flowchart illustrating a method for providing a GUI for reducing an image sticking effect in a display device according to an exemplary embodiment of the present invention.

Referring to FIG. 9, the items are distributed to a plurality of regions so as to be shifted per region.

The control unit 140 determines whether a display-on command is input through the input unit 120 at step 901 and, if the display-on command is input, controls the display unit 130 to display at least one item at a predefined position in the respective first and second regions at step 902.

The items displayed in the first region are the image objects that are changed in a relatively low frequency among all of the image objects displayed on the display unit 130 and can be the image objects providing the current status information of the display device 100. The current status information of the display device 100 can be any one of the cellular radio reception strength, the Wi-Fi radio reception strength, the current time, the battery status, the alarm setting, the Bluetooth radio on/off status, and the GPS on/off status.

The items displayed in the second region are the image objects that change in a relatively high frequency as compared to those displayed in the first region but in the low frequency as compared to the normal application icons, and can be the somewhat frequently used application icons, such as a phone icon, a message icon, an internet browser icon, and the like.

The display on/off control unit 141 determines whether a display-off command is input through the input unit 120 at step 903. If it is determined that the display-off command is input at step 903, the display on/off control unit 141 turns off the display unit 130 at step 904.

The display on/off control unit 141 then determines whether a display-on command is input at step 905 and, if the display-on command is input, turns on the display unit 130 and sends the item shift unit 142 a signal notifying of the input of the display-on command. If the display-on command is received from the display on/off control unit 141, the item shift unit 142 controls the display unit 130 to display the at least one item, in the first region, at the positions as distant as a predefined distance from the original positions at step 906. The item shift operations described with reference to FIG. 3 can also be applied to the exemplary embodiment of FIG. 9 in the same way.

Thereafter, the item shift unit 142 determines whether the number of accumulated on/off operations of the display unit 130 reaches a predefined value K at step 907, wherein K is a period for shifting the items in the second region.

If it is determined that the number of accumulated on/off operations of the display unit 130 reaches the value K at step 907, the icon shift unit 142 shifts the at least one item in the second region as much as the predefined distance from their original positions right before the display unit 130 turns off, on the screen of the display unit 130 at step 908. The item shift unit 142 then initializes the on/off operation counter to 0 at step 909.

If it is determined that the display-off command is not input at step 903, the display on/off control unit 141 determines whether a predefined time has elapsed after the items has been displayed at step 910. If the predefined time has elapsed, the display on/off control unit 141 turns off the display unit 130 at step 904 such that the display on/off control unit 141 and the item shift unit 142 perform steps 905 and 909.

Although the description of FIG. 9 has been directed to the case where the items are displayed in two regions, the present invention is not limited thereto and can be applied to the case where the items can be displayed in three or more regions.

Figure 10:
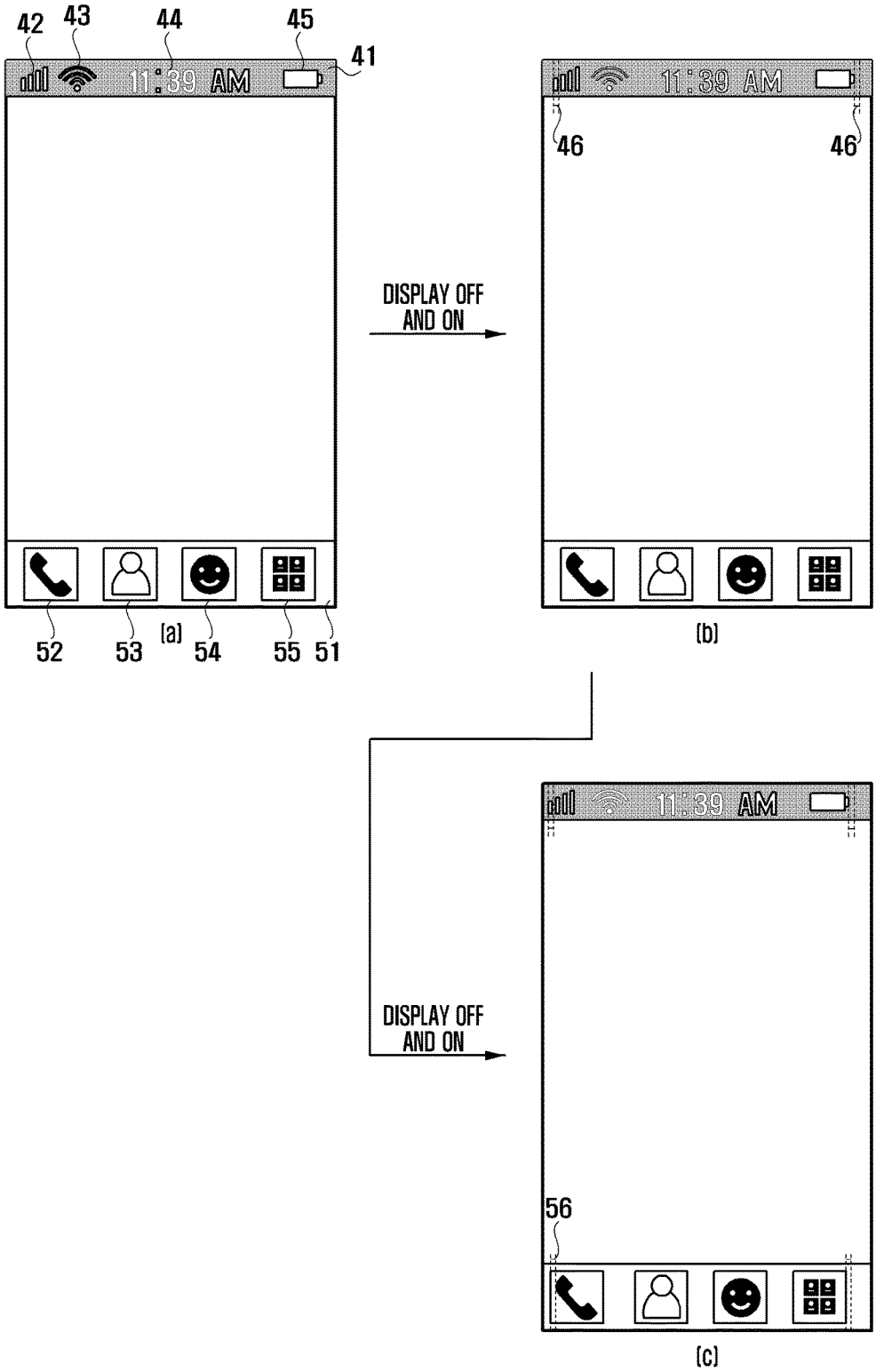
FIG. 10 illustrates screen images for explaining how to shift items on a screen of a display device according to an exemplary embodiment of the present invention.

FIG. 10 illustrates screen images for explaining how to shift items on a screen of a display device according to an exemplary embodiment of the present invention.

Referring to FIG. 10, it shows the screens displayed in a mobile communication terminal. Part [a] of FIG. 10 shows a screen having the first region 41 positioned at the top and presenting a plurality of items 42, 43, 44, and 45 and the second region 51 positioned at the bottom and presenting a phone item 52, a contact item 53, a message item 54, and a menu item 55. The first region 41 includes the cellular radio reception strength indicator item 42, the Wi-Fi radio reception strength indicator item 43, the current time indicator item 44, and a battery indicator item 45.

Part [b] of FIG. 10 shows the screen presented when the display unit 130 transitions from the off-state, as shown in the screen of part [a] of FIG. 19, to the on-state. In part [b] of FIG. 10, the items 42, 43, 44 and 45 of the first region 41 are shifted to the left as much as a predefined distance as compared to their original positions in part [a] of FIG. 10, and the items 52, 53, 54, and 55 of the second region 51 maintain their original positions.

Part [c] of FIG. 10 shows the screen presented when the display unit 130 transitions from the off-state, as shown in the screen of part [b] of FIG. 10, to the on-state. In part [c] of FIG. 10, the items 42, 43, 44, and 45 of the first region 41 are shifted to the left as much as the predefined distance 46 as compared to part [b] of FIG. 10, and the items 52, 53, 54, and 55 of the second region 51 are shifted to the left as much as a predefined distance 56 as compared to part [b] of FIG. 10.

In FIG. 10, the items that belonged to the first region 41 are shifted at every on/off operation of the display, and the items that belonged to the second region 51 are shifted at every two on/off operations of the display.

In the exemplary embodiments of FIGS. 9 and 10, the items are shifted at different timings according to the presentation change frequencies of the items so as to improve the image sticking effect reduction efficiency with minimum shift operations of the items displayed on the screen.

In the exemplary embodiments of FIGS. 9 and 10, the term 'subregion' denotes a region on a display device having a width that is less than twice a width of the items. The first region and the second region are examples of the subregion.

As described above, the display device of the present invention shifts the position of a specific image whenever the display turns on so as to reduce the image sticking effect caused by displaying a static image for an undesirably extended period of time. That is, the display device blurs the outline of ghost image by adjusting the position of a specific image, thereby prolonging the time taken for the user to perceive the ghost image.

In exemplary embodiments of the present invention, since the position shift is performed finely in units of 1 or two pixels, it is difficult for the user to perceive the position shift of the image with bare eyes, resulting in improvement of image sticking effect reduction efficiency.

While the invention has been shown and described with reference to certain exemplary embodiments thereof, it will be understood by those skilled in the art that various changes in form and details may be made therein without departing from the spirit and scope of the invention as defined by the appended claims and their equivalents.

What is claimed is:

1. A method for providing a graphical user interface (GUI) for reducing an image sticking effect in a display device, the method comprising:

displaying a plurality of icons at at least one respective initial position on a screen of the display device, the screen comprising a first region and a second region;

turning off the screen according to a predefined condition;

receiving a display-on input command for turning on the screen; and shifting at least one of the plurality of icons on the first region as much as a predefined distance from the initial position on the screen such that a distance between the plurality of icons is maintained without overlapping with each other after the plurality of icons are shifted while icons on the second region are fixed, wherein the plurality of icons on the first region comprise an indicator icon indicating a status of the display device, and wherein the plurality of icons on the first region are shifted in response to the display-on input command with a higher frequency than the icons on the second region.

2. The method of claim 1, wherein the shifting of the at least one of the plurality of icons comprises moving the at least one of the plurality of icons in a first direction as much as the predefined distance such that the distance between the plurality of icons is maintained without overlapping with each other after the plurality of icons are shifted.

3. The method of claim 2, wherein the moving of the at least one of the plurality of icons comprises displaying the at least one of the plurality of icons at a position shifted by one pixel in the first direction.

4. The method of claim 2, wherein the plurality of icons are arranged in a row horizontally, and wherein the shifting of the at least one of the plurality of icons comprises shifting at least one of the plurality of icons arranged in the row horizontally in a left or a right direction by as much as the predefined distance.

5. The method of claim 1, wherein the shifting of the at least one of the plurality of icons comprises moving the at least one of the plurality of icons in a first direction by one or two pixels.

6. The method of claim 1, wherein the shifting of the at least one of the plurality of icons comprises moving the plurality of icons one by one, or group by group, whenever the display-on command is input in an off-state of the screen.

7. The method of claim 1, wherein the screen comprises a first predefined region and a second predefined region, wherein the plurality of icons comprise at least one first item and at least one second item, and wherein the displaying of the plurality of icons comprises:

presenting at least one first item at at least one respective first initial position in the first region, and presenting at least one second item at at least one respective second initial position in the second region.

8. The method of claim 7, wherein the shifting of the at least one of the plurality of icons comprises:

displaying the at least one first item at at least one respective first position as distant as the predefined distance from the at least one respective first initial position in the first region;

determining if a number of times the display-on command is input in an off-state of the screen reaches a predefined value;

displaying, when the number of times the display-on command is input reaches the predefined value, the at least one second item at at least one respective second position as distant as the predefined distance from the at least one respective second initial position in the second region; and initializing the number of times the display-on command is input to zero (0).

9. A display device comprising:

a display configured to display a plurality of icons at at least one respective initial position on a screen of the display device, the screen comprising a first region and a second region;

a display on/off device processor configured to turn on/off a screen of the display device according to a predefined condition;

an input device configured to receive a display-on input command for turning on the screen; and an item shift device configured to control, when the display-on command is input through the input device in an off-state of the screen, the display to display at least one of the plurality of icons on the first region at a position as distant as a predefined distance from the at least one respective initial position while icons on the second region are fixed, wherein the item shift device is further configured to shift at least one of the plurality of icons such that a distance between the plurality of icons is maintained without overlapping with each other after the plurality of icons are shifted, wherein the plurality of icons on the first region comprise an indicator icon indicating a status of the display device, and wherein the plurality of icons on the first region are shifted in response to the display-on input command with a higher frequency than the icons on the second region.

10. The display device of claim 9, wherein the item shift device is further configured to control the display to shift the at least one of the plurality of icons by a number of pixels within a range of a predefined number of pixels in a first direction.

11. The display device of claim 10, wherein the plurality of icons are arranged in a row horizontally, and wherein the item shift device is configured to shift at least one of the plurality of icons arranged in the row horizontally in a left or a right direction by as much as the predefined distance.

12. The display device of claim 9, wherein the item shift device is further configured to shift the at least one of the plurality of icons one by one, or group by group, whenever the display-on command is input in the off-state of the screen.

13. The display device of claim 9, wherein the screen comprises a first predetermined region and a second predetermined region, wherein the plurality of icons comprises at least one first item and at least one second item, wherein the display is configured to display the at least one first item at at least one respective first initial position in the first region, wherein the item shift device is configured to display the at least one first item at at least one respective first position as distant as the predefined distance from the at least one respective first initial position in the first region in response to the display-on command, and wherein the item shift device is further configured to:

determine if a number of times the display-on command is input in the off-state of the screen reaches a predefined value, display, when the number of times the display-on command is input reaches the predefined value, the at least one second item at at least one respective second position as distant as the predefined distance from the at least one respective second initial position in the second region, and initialize the number of times the display-on command is input to zero (0).

14. The display device of claim 9, wherein the item shift device is further configured to:

determine whether an elapsed time reaches a predefined period while the at least one of the plurality of icons is displayed at the at least one respective initial position, determine, when the elapsed time reaches the predefined period, whether a screen of the display device is in an on-state, and shift, when the screen of the display device is in the on-state, the at least one of the plurality of icons as much as a predefined distance on the screen.

15. An electronic apparatus comprising:

a display, having a plurality of self light emitting pixel elements, a predefined first display area configured to display a plurality of status icons, and a second display area; and at least processor configured to:

change a position of the plurality of status icons displayed on the first display area by shifting the position of the plurality of status icons by one or two pixels such that partially different sets of the self light emitting pixel elements are energized to display the plurality of status icons while icons on the second region are fixed, and shift at least one of the plurality of status icons such that a distance between the plurality of status icons is maintained without overlapping with each other after the plurality of status icons are shifted, wherein the plurality of status icons on the first region are shifted in response to the display-on input command with a higher frequency than the icons on the second region.

16. The apparatus of claim 15, wherein the display comprises an active matrix organic light-emitting diode (AMOLED) display, and wherein the at least processor is further configured to change the position of the plurality of status icons to reduce an image sticking effect caused by the self light emitting pixel elements of the AMOLED display being energized for long periods of time.

17. An electronic apparatus comprising:

a display, having a plurality of self light emitting pixel elements, configured to display a plurality of status icons on a first region and to display icons on a second region; and at least processor configured to:

display the plurality of status icons at an initial location within the first region, change a position of the plurality of status icons to a different location within the first region such that the plurality of status icons, in its entirety, continuously remains within a boundary of the first region having a width that is less than twice a width of the plurality of status icons and such that partially different sets of the self light emitting pixel elements are energized to display the plurality of status icons while icons on the second region are fixed, and shift at least one of the plurality of status icons such that a distance between the plurality of status icons is maintained without overlapping with each other after the plurality of status icons are shifted, wherein the plurality of status icons on the first region are shifted in response to the display-on input command with a higher frequency than the icons on the second region.

18. The apparatus of claim 17, wherein the display comprises an active matrix organic light-emitting diode (AMOLED) display, and wherein the at least processor is further configured to change the position of the plurality of status icons to reduce an image sticking effect caused by the self light emitting pixel elements of the AMOLED display being energized for long periods of time.

19. The apparatus of claim 17, wherein the at least processor is further configured to change a position of the plurality of status icons by shifting the position of the plurality of status icons by one or two pixels.

20. The apparatus of claim 19, wherein the at least processor is further configured to change the position of the plurality of status icons such that shifting of the plurality of status icons is not noticeable by a user.

* * * * *